US006253808B1

(12) United States Patent
Amberg et al.

(10) Patent No.: US 6,253,808 B1
(45) Date of Patent: Jul. 3, 2001

(54) DEVICE FOR METERING A PASTRY PRODUCT

(75) Inventors: Guenther Amberg, Neuss; Wolfgang Huber, Friedolfing; Karsten Wolf, Korschenbroich; Klaus Rutz, Vachendorf, all of (DE)

(73) Assignee: Henkel-Ecolab GmbH & Co. OHG, Duesseldorf (DE)

( * ) Notice: Subject to any disclaimer, the term of this patent is extended or adjusted under 35 U.S.C. 154(b) by 0 days.

(21) Appl. No.: 09/554,723

(22) PCT Filed: Nov. 10, 1998

(86) PCT No.: PCT/EP98/07163

§ 371 Date: Aug. 1, 2000

§ 102(e) Date: Aug. 1, 2000

(87) PCT Pub. No.: WO99/25639

PCT Pub. Date: May 27, 1999

(30) Foreign Application Priority Data

Nov. 19, 1997 (DE) ..... 197 51 154

(51) Int. Cl.[7] ..... B65B 1/04

(52) U.S. Cl. ..... 141/330; 141/9; 141/100; 222/81

(58) Field of Search ..... 406/48; 222/52, 222/81, 82; 141/329, 330, 9, 100

(56) References Cited

U.S. PATENT DOCUMENTS 2,584,167 2/1952 Sundholm et al. ..... 226/125
4,699,188 10/1987 Baker et al. ..... 141/18
4,889,644 12/1989 Amberg et al. ..... 252/8.9
4,905,904 * 3/1990 Ohara et al. ..... 239/284.1
4,998,850 * 3/1991 Crowell ..... 222/52

FOREIGN PATENT DOCUMENTS 295525 6/1988 (DE) .
0428451B1 6/1989 (GB) .

* cited by examiner

*Primary Examiner*—Steven O. Douglas
(74) *Attorney, Agent, or Firm*—Wayne C. Jaeschke; Glenn E. J. Murphy; Kenneth Watov

(57) ABSTRACT

A device for metering a pasty product and mixing the same with a solvent has an exchangeable packing drum containing the pasty product and arranged in a dimensionally stable container, and a vacuum metering device arranged below the container. An outlet of the packing drum which extends through a bottom opening in the container is coupled to a product inlet of the metering device. In order to ensure in a reliable manner that the pasty product exits the packing drum only when the packing drum is coupled to the metering device, to avoid product coming in contact with service personnel, the outlet of the packing drum is designed as an outlet spout. A tubular spout holder is provided in the area of the product inlet, and is fitted with an inner cutting element. The cutting element pierces the seal material covering the free end of the outlet spout, as the latter is installed on the tubular spout holder.

9 Claims, 2 Drawing Sheets

DEVICE FOR METERING A PASTRY PRODUCT

BACKGROUND 1.0 Field of the Invention

The invention relates generally to a device for metering a pasty product and mixing the same with a solvent, and more specifically so such a device having an exchangeable storage container which is arranged in a dimensionally stable vessel and holds the pasty product, and having a metering arrangement which is arranged beneath the vessel and performs a feeding action by means of negative pressure.

2.0 Discussion of Related Art

Liquid to pasty detergents are known. These detergents are generally used for to domestic requirements, which means that they are to be sufficiently free-flowing and can be easily poured out and metered. Since, moreover, they are intended to be stable under storage conditions within a relatively large temperature range, it is typically necessary to use organic solvents and/or hydrotopic additives. However, these additives do not have any washing action, are comparatively costly, and take up additional packaging volume as well as additional transporting and storage capacity. Also problematic, in particular, is use of inflammable solvents which, on account of the comparatively high throughput of detergents in laundries, require additional safety precautions. Detergent concentrates of this type therefore cannot be used, or can only be used with very heavy restrictions, in laundries.

It is mainly pulverulent detergents which are thus used in laundries. Since, in particular in large concerns with wide-scale automation, precise metering of such media is labor-intensive, the media are usually stored, and metered, in predissolved form as mother liquors, i.e. an aqueous concentrate is made up and is then supplied to the individual locations of use. However, the detergents which are usually used in laundries contain relatively high proportions of wash alkalis which are only soluble to a limited extent in cold water and, furthermore, result in salting-out effects. They cause phase separation, with the result that the organic components, in particular the nonionic surfactants and soaps, separate out and cream up. It is therefore necessary to work with relatively strong aqueous dilution, and the mother liquors additionally must be constantly mixed and circulated, in order to prevent individual components from separating out in the supply lines to the locations of use. Such processes thus require expensive large-volume mixing vessels, and the associated statics for mixers and feed devices, as well as a constant supply of energy for the temperature control and pumped circulation of the mother liquors.

A detergent which fulfills these requirements is described in EP 0 295 525 A1. This is a pasty detergent which requires special handling for the metering and mixing with water serving as a solvent. Such detergent pastes are transported and stored in large containers. It is proposed for these storage containers to be positioned in a dimensionally stable vessel arranged above the metering arrangement, and for the paste to be guided in a downwardly sloping manner. It is necessary at this point, prior to the insertion of the storage container, for the latter to be opened in the region of its outlet, which may result in the pasty product emerging from the storage container, and coming into contact with the operating staff, even during the operation of inserting the supply container. However, since such detergent pastes may constitute a hazardous substance, the situation where the pasty product emerges in an uncontrolled manner from the storage container is to be reliably avoided.

SUMMARY OF THE INVENTION

An object of the invention is to develop a device of the generic type further such that it is reliably ensured that the pasty product emerges from the storage container, without coming into contact with the operating staff, when the storage container has been coupled to the metering arrangement.

This object is achieved according to the invention, by a device of the type described above, wherein the outlet of the storage container is designed as an outlet nozzle, and provided in the region of the product inlet is a tubular nozzle holder equipped with an interior cutting element, and into which the outlet nozzle can be inserted such that the cutting element pierces the sealed free end of the outlet nozzle.

A device designed in this way reliably avoids the situation where the pasty product can emerge in an uncontrolled manner from the storage container before the storage container has been coupled to the metering arrangement. The storage container is simply positioned in the dimensionally stable vessel above the metering arrangement, as a result of which the outlet nozzle of the storage container automatically passes into the tubular nozzle holder and finally, during or after full insertion, the sealed outlet nozzle is pierced open by the cutting element of the nozzle holder, with the result that the storage container is thus only opened when the storage container has already been fully inserted into the vessel.

A particularly advantageous configuration provides that the cutting element is designed as a hollow needle which is tapered and provided with a particular ground finish. This ensures that the outlet nozzle is cut or pierced open in a controlled manner, which provides the essential advantage that when the storage container is removed before it has been fully emptied, e.g. in the event of disruption, the pierced-open outlet-nozzle part springs back into its starting position and the pasty product is thus prevented from emerging.

It is advantageously provided that the nozzle holder can be inserted in the form of an adapter into the product inlet of the metering arrangement. It is possible for the nozzle holder, for example, to be screwed in or inserted into the product inlet in the manner of a bayonet closure. This means that the nozzle holder can easily be exchanged or removed in order for the cutting element to be changed or repaired, if necessary.

It is further advantageously provided that a sealing element is arranged between the nozzle holder and the product inlet and/or the nozzle holder and the outlet nozzle, which reliably ensures that the metering arrangement, which performs a feeding action by means of negative pressure, operates fully satisfactorily, i.e. it is not possible any ambient air to pass into the product inlet.

Moreover, it is advantageously provided that the outlet nozzle has a stop collar at the free end, the stop collar bounding the introduction path of the outlet nozzle in the nozzle holder.

It is further advantageously provided that arranged in the region of the product inlet is a movable closure plunger which, in the closure position, seals the through-passage opening of the nozzle holder, said opening being formed by the hollow needle.

BRIEF DESCRIPTION OF THE DRAWINGS

The invention is explained in more detail by way of example hereinbelow with reference to the drawing, in which.

DETAILED DESCRIPTION OF THE INVENTION

Figure 1:
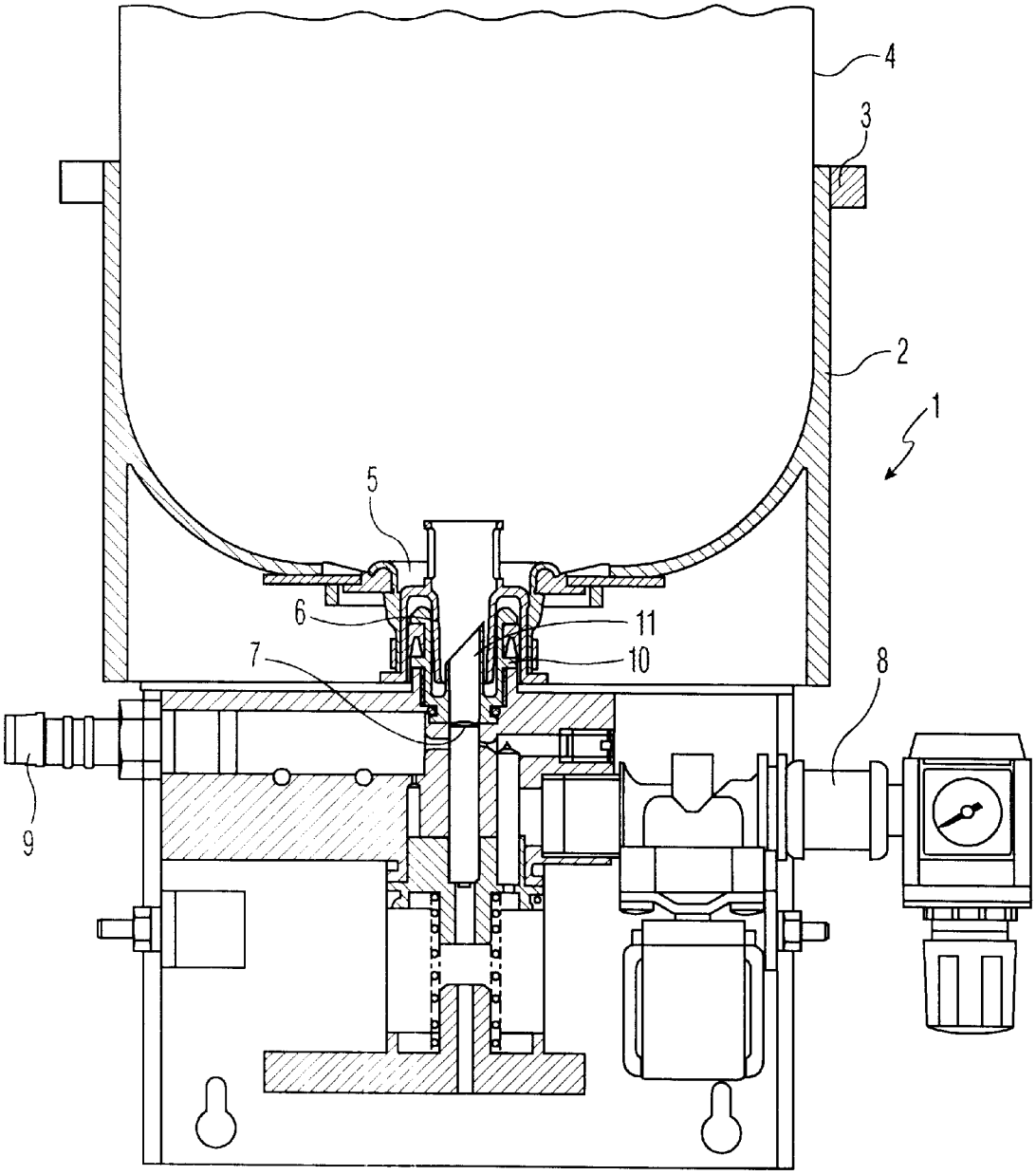
FIG. 1 shows a cross section through a device according to the invention.

A device for metering a pasty product and mixing the same with water has, in accordance with the invention, a metering arrangement, which is designated in general terms by reference numeral 1. This metering arrangement 1 is equipped with a framework on which there is arranged a dimensionally stable vessel 2, which may be equipped with handles 3. It is possible to position in vessel 2 a flexible storage container 4, of which only the bottom region is illustrated. The base of the vessel 2 is provided with a central, bottom opening 5 through which an outlet nozzle 6 of the storage container 4 can be guided and into the metering arrangement 1 projects, which as explained more specifically hereinbelow.

The specifics of the basic construction of the metering arrangement 1 are familiar to a person skilled in the art, so that no further details will be given on this subject, with the exception of the parts which are essential to the invention. For holding and for taking in the pasty product from the storage container 4, the metering arrangement 1 has a product inlet 7, and a water inlet 8. By virtue of the negative pressure which arises in the region of the product inlet 7 as a result of the flow of the incoming water, the water is mixed with the pasty product taken in and emerges, through an outlet 9, from the metering arrangement 1 in the desired metering ratio.

It is essential to the configuration of the device according to the invention for there to be arranged in the region of the product inlet 7 of the metering arrangement 1 a tubular nozzle holder 10 which is equipped with a cutting element 11 on the inside. In this case, the cutting element 11 is preferably designed as a hollow needle.

Figure 2:
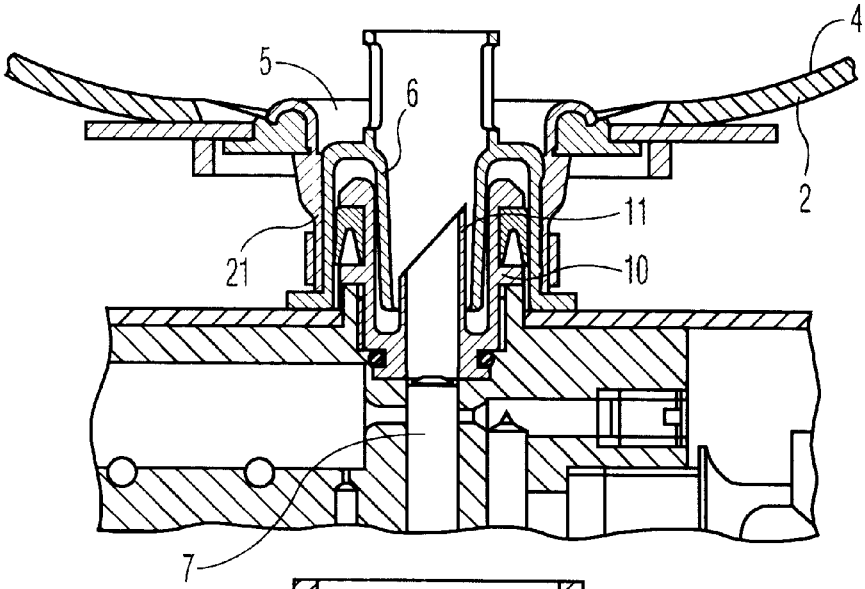
FIG. 2 shows an enlarged detail of a portion of FIG. 1 in cross section.
Figure 4:
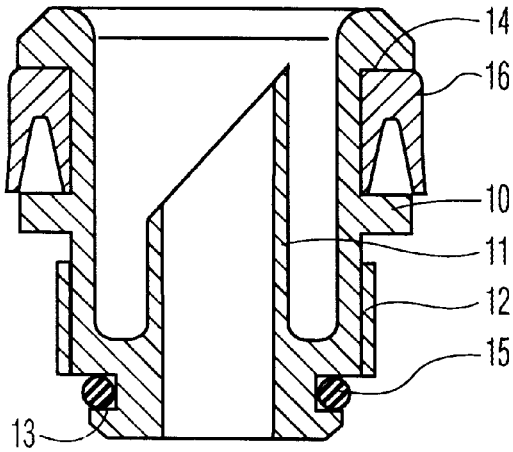
FIG. 4 shows a section through a nozzle holder of the device.

As can best be seen from FIGS. 2 and 4, the nozzle holder 10 can preferably be inserted in the form of an adapter into the product inlet 7, e.g. by means of a screw thread; a screw thread is designated 12 in FIG. 4. The product inlet 7 of the metering arrangement 1 is configured correspondingly, although this is not illustrated specifically, with the result that the nozzle holder 10 can easily be inserted and/or exchanged.

If a storage container 4 is inserted into the vessel 2, then the closed outlet nozzle 6 of the storage container 4 passes through the opening 5 of the vessel into the region of the product inlet 7 and, during this operation, the sealing material 22 is pierced, i.e. opened, at the end by the cutting element 11, which is in the form of a hollow needle. The storage container 4 is thus only opened when the storage container 4 has been virtually fully inserted into the vessel 2, for reliably ruling out the situation where the detergent paste comes into contact with the operating staff. If the storage container 4 is removed again, the nozzle part pierced by the hollow-needle cutting element 11 springs back into its starting position and thus closes the storage container 4 again, with the result that product residues cannot emerge in an uncontrolled manner from the storage container 4. This is of considerable advantage, in particular, if the storage container 4 has to be removed before emptying has taken place, for example in the event of disruption.

Figure 3:
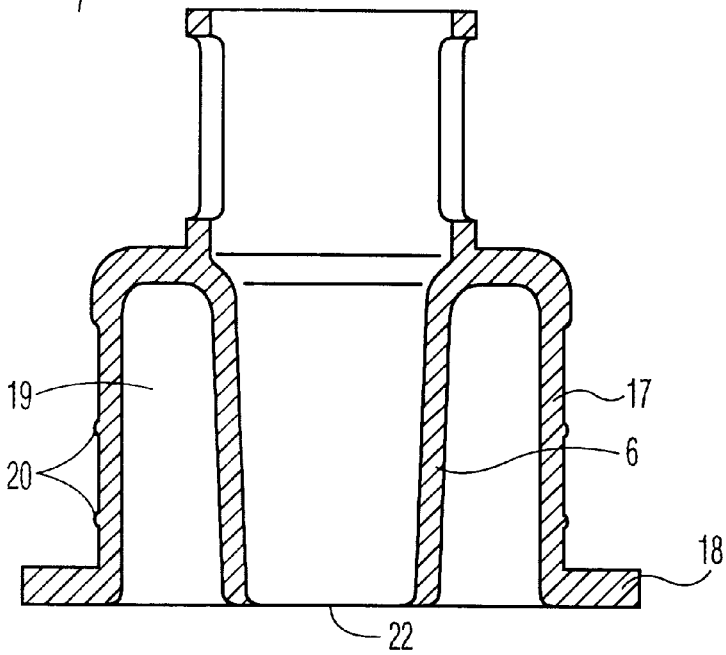
FIG. 3 shows a section through an outlet nozzle of the storage container.

Further preferred details of the outlet nozzle 6 and of the nozzle holder 10 can be gathered from FIGS. 2 to 4. Thus, according to FIG. 4, preferably two encircling grooves 13, 14 are provided on the nozzle holder, and it is possible to insert in said grooves in each case one sealing ring 15, 16 or the like in order to ensure that the nozzle holder 10 is sealed in the region of the product inlet 7 (sealing ring 15) and in the connecting region to the outlet nozzle 6 (seal 16), in order to ensure satisfactory functioning of the metering arrangement 1 operating with negative pressure.

As can best be seen from FIG. 3, the outlet nozzle 6 has, for its centered position in and/or on the nozzle holder 10, an annular outer region 17 which is provided with a stop collar 18 at the free end. Formed between the actual outlet nozzle 6 and the outer region 17 is a clearance 19 in which the nozzle holder 10 engages as it is joined together with the nozzle 6, as is illustrated in FIG. 2. In this case, the seal 16 butts in a sealing manner against the inside of the annular outer region 17. The stop collar 18 serves for bounding the introduction movement of the outlet nozzle 6 in the downward direction as a storage container 4 is inserted into the vessel 2. The stop collar 18 then butts against a housing wall of the metering device 1.

The outlet nozzle 6 may, in principle, be sealed directly to the opening of the storage container 4. In the illustrated exemplary embodiment according to FIG. 2, the annular outer region 17, however, has additional latching beads 20, which produce a latching connection to a tubular connecting adapter part 21 which, on the outside, is sealed to the opening of the storage container 4, if appropriate with the interposition of further elements.

The nozzle holder 10 illustrated in FIG. 4 may also be fastened in the region of the product inlet 7 in some other way, for example by means of a bayonet closure or the like. It is also possible, although this is not illustrated, to arrange in the region of the product inlet 7 a movable closure plunger which, in the closure position, seals the through-passage opening of the nozzle holder 10, said opening being formed by the hollow needle 11. Moreover, it is possible, in principle, for the cutting element 11 to be of some other form, etc.

Although various embodiments of the invention have been shown and described in detail, they are not meant to be limiting. Those of skill in the art may recognize various modifications to these embodiments, which modifications are meant to be covered by the spirit and scope of the appended claims.

What is claimed is:

1. A device for metering a pasty product and mixing the same with a solvent, comprises:

a replaceable storage container for containing a supply of said pasty product, said storage container including on a bottom surface an outlet nozzle having an annular outer region;

a dimensionally stable vessel for receiving and holding said storage container, said vessel including a bottom opening for receiving said outlet nozzle which projects therethrough;

a metering arrangement located below said bottom opening of said vessel;

said metering arrangement including a product inlet for receiving a portion of said outlet nozzle, said metering arrangement being operable for applying negative pressure for drawing said pasty product from said storage container;

said outlet nozzle of said storage container including an inner annular wall region, and an outer annular wall region spaced apart from said inner annular wall region, thereby forming a clearance region therebetween, said inner annular wall forming a pathway for passage of said pasty product;

a tubular nozzle holder configured for retention in said product inlet of said metering arrangement, said tubular nozzle holder including in a lower portion an interior cutting element, said tubular nozzle holder being further configured for receiving said outlet nozzle and piercing via said cutting device a free end of said outlet nozzle, a portion of the inner annular wall region being retained in an interior portion of said tubular nozzle holder, and an interior portion of said outer annular wall region surrounding an upper exterior portion of said tubular nozzle holder.

2. The device as claimed in claim 1, wherein the nozzle holder is configured as an adapter for insertion into the product inlet of the metering arrangement, and a sealing element is arranged between the nozzle holder and the product inlet.

3. The device of claim 2, wherein said outlet nozzle includes a stop collar formed about a bottom portion of said outer annular wall.

4. The device of claim 2, wherein said cutting element is designed as a hollow needle.

5. The device as claimed in claim 1, wherein the outlet nozzle includes a stop collar formed about a bottom portion of said outer annular wall.

6. The device of claim 5, wherein said cutting element is designed as a hollow needle.

7. The device as claimed in claim 1, wherein the cutting element is designed as a hollow needle.

8. The device as claimed in claim 7, wherein arranged in the region of the product inlet is a movable closure plunger which, in the closure position, seals a through-passage opening of the nozzle holder, said opening being formed by the hollow needle.

9. The device of claim 1, further including:

a sealing element arranged within the clearance region of said outlet nozzle between the latter, and an upper portion of said tubular nozzle holder, for providing a fluid seal therebetween.

* * * * *